US005249922A

United States Patent [19]

Sato et al.

[11] Patent Number: 5,249,922

[45] Date of Patent: Oct. 5, 1993

[54] APPARATUS OF STATIONARY BLADE FOR AXIAL FLOW TURBINE, AND AXIAL FLOW TURBINE

[75] Inventors: Takeshi Sato; Yoshiaki Yamazaki, both of Hitachi, Japan

[73] Assignee: Hitachi, Ltd., Tokyo, Japan

[21] Appl. No.: 760,497

[22] Filed: Sep. 16, 1991

[30] Foreign Application Priority Data

Sep. 17, 1990 [JP] Japan ..... 2-244051

[51] Int. Cl.[5] ..... F01D 1/02

[52] U.S. Cl. ..... 415/191; 416/223 A; 415/192; 415/208.1

[58] Field of Search ..... 416/223 A; 415/191, 415/192, 208.1, 208.2, 209.1, 210.1

[56] References Cited

U.S. PATENT DOCUMENTS 1,526,815 2/1925 Warren ..... 416/223 A 2,378,372 6/1945 Whittle ..... 415/192

4,470,755 9/1984 Bessay ..... 416/223 A

*Primary Examiner*—Edward K. Look

*Assistant Examiner*—Mark Sgantzos

*Attorney, Agent, or Firm*—Antonelli, Terry, Stout & Kraus

[57] ABSTRACT

An apparatus of stationary blade for an axial flow turbine includes a diverging flow channel for flowing an elastic fluid and stationary blades which are fixed at the diverging flow channel and are curved in perpendicular direction to the flow direction of the elastic fluid. The stationary blades form the same tangential lean angles at the leading edge and the trailing edge of the stationary blade corresponding to the flow direction of the elastic fluid, and an axial flow turbine has the apparatus of stationary blades thereof. The stationary blade distributes the fluid in the flow channel uniformly and, consequently, improves the efficiency of the flow.

10 Claims, 9 Drawing Sheets

APPARATUS OF STATIONARY BLADE FOR AXIAL FLOW TURBINE, AND AXIAL FLOW TURBINE

FIELD OF THE INVENTION

The present invention relates to an improvement of stationary blades of an axial flow turbine and, especially, to the improvement of the stationary blades which are installed in diverging flow channel.

DESCRIPTION OF THE PRIOR ART

In a large capacity steam turbine, the change of the specific volume of fluid with the change of pressure at the low pressure section is large and, consequently, the diverging flow channel R is steep as illustrated in FIGS. 5(*a*) and (*b*). A turbine stage, which is installed in the flow channel, is composed of stationary blades 1 and moving blades 2. As the elastic fluid, which has passed through the stationary blades, has necessarily a tangential velocity component $V\Theta$; a pressure gradient in Y axis direction is generated, and, consequently, the elastic fluid becomes a three dimensional flow having tangential velocity component $V\Theta$, axial velocity component $V_z$ and radial velocity component $V_r$ as velocity components, and it flows in a direction having a lean angle $\mu$ to axial direction (Z axis) of the turbine with meridional plane velocity $V_m$ as shown in FIG. 5(*a*). Naturally, the lean angle $\mu$ is changeable depending on the pressure gradient in the Y axis direction and the flare angle $\phi$ of the outer wall 3. With respect to the relation between flow pattern and turbine stage performance of the elastic fluid in such an annular flow channel as described above, various investigations have been performed for a long time. Hereinafter, the technical content of the prior art is explained.

Three examples of the stationary blade 1 having different arranging shapes in the tangential direction respectively at the annular flow channel are illustrated in FIGS. 6(*a*), (*b*), and (*c*). In the case of FIG. 6(*a*) the stationary blade 1 is installed coincidently with the radial direction, that is perpendicular to the center of the turbine axis in the radial direction, and FIG. 6(*b*) is the case in which the stationary blade is installed with the lean angle of $\gamma_t$ to the radial direction blade tip A. And, FIG. 6(*c*) is the case in which the stationary blade is formed in a curved shape and arranged such that the lean angle $\gamma_t$ at the tip A becomes reversed to the lean angle $\gamma_r$ at the hub B by the gradual change of the lean angle of the stationary blade 1 from the hub B to the tip A. The tangential lean angle distribution in the radial direction of the stationary blades in FIGS. 6(*a*), (*b*), and (*c*) are illustrated in FIG. 7. In FIG. 7, the axis 1*a* has no lean in the tangential direction, that is, the case of (*a*) in FIG. 6 and the lean angle is zero. The curve 2*b* is the form of FIG. 6(*b*) in FIG. 6, that is the case in which the lean angle at the hub, $\gamma_r$, and at the tip $\gamma_t$, inclines in same direction as the tangential direction with respect to the relation, $\gamma_r > \gamma_t$. The curve 3*c* is the case of the curved stationary blade, that is FIG. 6(*c*) in FIG. 6, and the lean angle $\gamma$ becomes smaller gradually from the hub to the tip and becomes zero at a certain point of the blade length, and the lean angle $\gamma$ inclines in the reverse direction from the certain point of the blade to the tip. The leaned stationary blade in the radial direction, that is, the concrete shape of the stationary blade composing of (b) and (c) in FIG. 6 are illustrated in FIG. 8 and 9.

The flow pattern of the fluid with the stationary blade which is formed as described above, that is each of the stationary blades illustrated in FIGS. 6(*a*), 6(*b*) and 6(*c*) in FIG. 6, is illustrated in FIGS. 10(*a*), 10(*b*) and 10(*c*) respectively, and the shape of low lines F in the whole flow area becomes different from each other. FIG. 10(*a*) is the case in which there is no lean angle ($\gamma=0$) in the radial direction with the stationary blade 1, and the case has a tendency that the flow rate is apt to be less at the region near the hub of the blade (A1 in FIG. 10(*a*)) and much more at the region near the tip of the blade reversely by the relation of the pressure gradient in the radial direction and the relation of the centrifugal force. The FIG. 10(*b*) is the case that the stationary blade inclines in one direction of the tangential direction (refer to FIG. 8), and, in this case, there is no low flow rate region as the A1 region near the hub of the blade of FIG. 10(*a*) as described above. But, in this case, the low flow rate region (A2 region) is generated near the tip of the blade as illustrate in FIG. 10(*b*), and the flow is not suitable for the diverging shape of the outer wall 3. As the solution of the problems as the hub and the tip of the blade, the curving of the stationary blade in tangential direction, that is, the curved stationary blade as illustrated in FIGS. 6(*c*) and 9 has been proposed.

With the curved blade in the tangential direction, as the hub and the tip of the blade are inclined, the problem of low flow rate of the fluid at the hub and the tip of the blade is thought to be solved apparently by proper selection of the lean angle. Actually, sufficient streamline distribution is obtained by using the curved blade to the parallel flow channel. But, if the liquid flow channel is the diverging flow channel as described above, the region of unstable low flow rate is generated near the tip of the blade by the reason to be described later, and further, the flow of the liquid by the curved blade undesirably influences the stationary blade in the down stream side, that is, additional loses are generated by the moving blade.

The reason, which is revealed by experiments relating to the present invention, is as follows:

The reason is that the shape of the flow channel is not considered in the selection of the lean angle of the curved stationary blade at each position in the radial direction; although, various other factors are considered at the selection. That is, as illustrated in FIG. 11, with a real turbine, the stationary blade width in the axial direction of the turbine is enlarged gradually from the hub Br to the tip B, and, as the shape of the tip region is the one that the outer wall 3 is enlarged, there is such a relation between tip radius $r_{to}$ at the outlet edge (tailing edge) of the stationary blade 1 and tip radius $r_{ti}$ at the inlet edge (leading edge) of the stationary blade as $r_{to} > r_{ti}$. Accordingly, the lean angle at the tip of the stationary blade becomes different at the point a, point b, and the point c at the outlet edge 4 of the stationary blade 1 has the equivalent lean angle to the lean angle at the point a of the inlet side. The points described above are illustrated as a, b, and c in FIG. 7, and the lean angle at point a becomes smaller than the lean angle at the point b. Consequently, the flow direction of the fluid follows the lean angle, and the shape of the curved stationary blade is not able to achieve the flow pattern which is suitable for such shape of diverging flow channel as $A_3$ in FIG. 10(*c*).

SUMMARY OF THE INVENTION

The present invention is achieved in consideration of the problem described above, and is aimed at providing such a stationary blade as to be able to normalize the flow in the turbine stage and perform with high efficiency; although, the stationary blade is installed in the diverging flow channel.

The present invention is to achieve the aimed objects by forming a tangential lean angle at each position of the stationary blade equally each other on the line, which is drawn in the radial direction from the origin of flare angle of the diverging flow channel and is the crossing inlet and the outlet of the stationary blade.

By forming the tangential lean angle as described above, the curved lean angle of the stationary blade in the direction of the elastic flow of the fluid becomes the same as the curved lean angle of the stationary blade at the inlet and the outlet on the line of the flow direction of the fluid, and consequently, the force relating to transference of the fluid in the radial direction becomes almost the same respectively and the flow of the fluid in the diverging flow channel becomes a uniform distribution. Accordingly, various loses in the turbine stage can be reduced.

BRIEF DESCRIPTION OF THE DRAWINGS

FIG. 5(*b*) is a perspective view illustrating the flow line of the fluid in the diverging flow channel.

DETAILED DESCRIPTION OF THE INVENTION

Hereinafter, the embodiment of the present invention is explained in detail with respect to the drawings.

Figure 1:
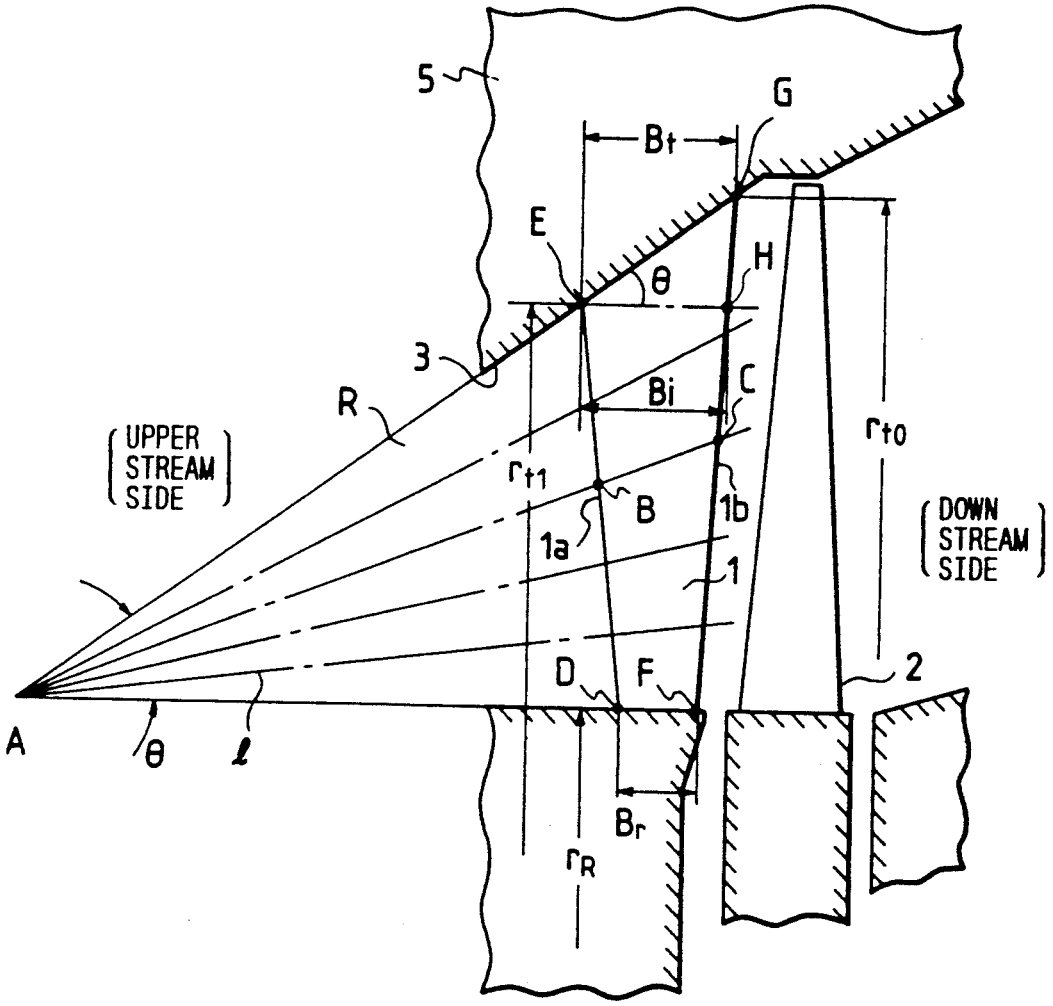
FIG. 1 is a schematic view of a vertical section illustrating the region around the stationary blade of the present invention.

As illustrated in FIG. 1, a stage which is adopted by a steam turbine is illustrated by a cross section. The stage is provided with the turbine casing 5 forming a diverging flow channel R, the stationary blade 1 which is installed in the diverging flow channel, and the moving blade 2 which is arranged in the down stream side of the stationary blade.

The tip of the stationary blade 1 has a wide width, that is, the width of the tip Bt is formed wider than the width of the hub Br and, moreover, the tip is formed in a shape which coincides with the diverging inner wall 3 of the casing 5, that is, the blade length is progressively enlarged on the down stream side.

The stationary blade 1 has a curved shape in the tangential direction (vertical to the drawing paper) although it is not shown in FIG. 1. The curvature of the stationary blade is illustrated in FIG. 2.

The stationary blade 1 is formed with the curvature in the tangential direction as described above, especially the curved lean angles ($\gamma_{to}$, $\gamma_{Ro}$, $\Gamma_{ti}$, $\gamma_{Ri}$) are formed as following. In FIG. 1, when the line l is drawn from the origin A of the flare angle of the diverging flow channel R to the radial direction, the line intersects the inlet 1*a* and the outlet 1*b* of the stationary blade. The curved lean angles at the inlet 1*a* and the outlet 1*b* of the stationary blade on the crossing line l are so formed as to have same angle. That is, in FIG. 1, E and G, E and C, and D and F are formed with same curved lean angles respectively.

Figure 2:
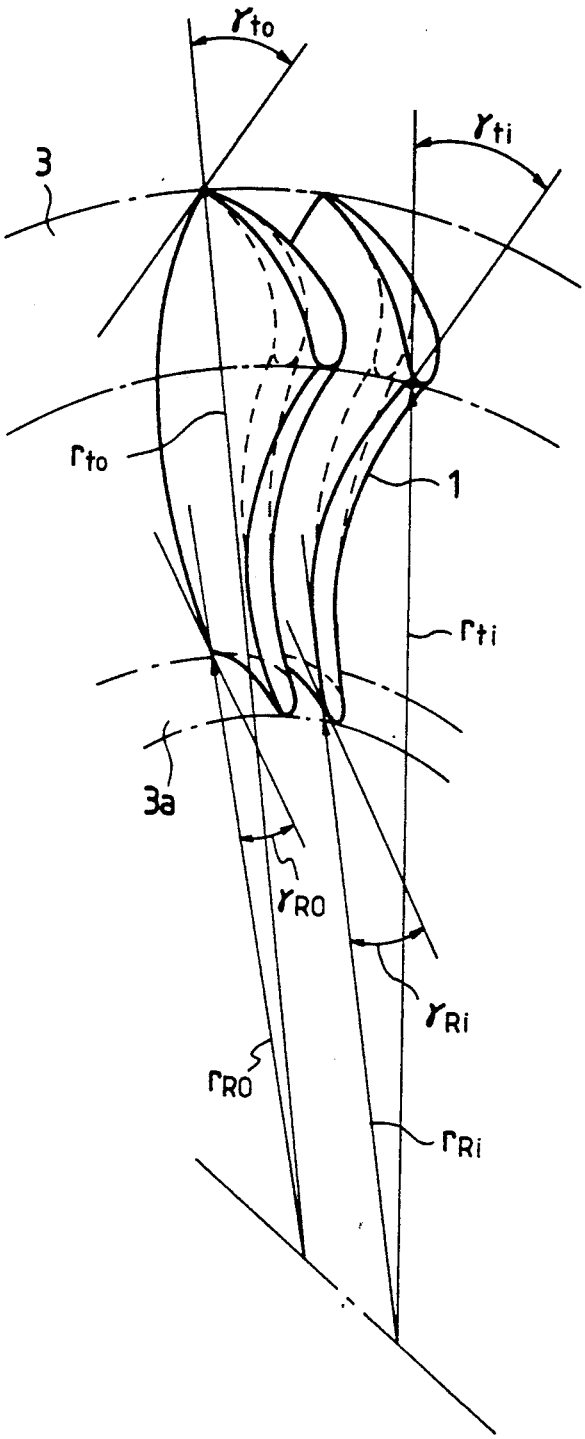
FIG. 2 is a perspective view illustrating the stationary blade of the present invention.
Figure 3:
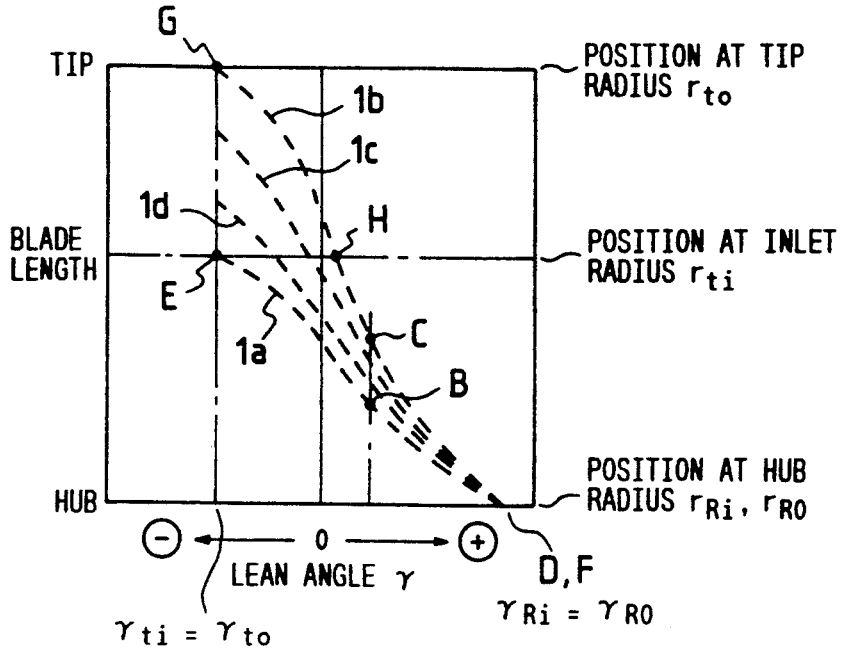
FIG. 3 is a graph illustrating the relation between the lean angle and the radial position at the stationary blade of the present invention.

In other words, referring to FIG. 2, the stationary blade 1 is so formed that the lean angles become $\gamma_{Ri}=-\gamma_{Ro}$, because $\gamma_{Ri}=\gamma_{Ro}$ at the inner wall 3*a* when the flow channel has such shape that radius $r_{to}$ at outlet edge of the stationary blade is larger than radius $r_{ti}$ at inlet edge of the stationary blade of the outer wall 3, while, at the outer wall 3, the lean angle $\gamma$ of the stationary blade 1 is so constructed with a gradual change from the side of the inner wall 3*a* to the side of the outer wall 3 so that the lean angle $\gamma_{ti}$ at the stationary blade inlet and the lean angle $\gamma_{to}$ at the outlet becomes the same. The change of the lean angle with blade length is illustrated in detail in FIG. 3. In FIG. 3, each of the points B, C, D, E, F and G corresponds to the position points on each of the lines which are drawn from the origin of the flare angle of the flow channel in FIG. 1. Therefore, the lean angle at the stationary blade inlet 1*a* in FIG. 1 follows the curve 1*a* in FIG. 3, and the lean angle at the stationary blade outlet 1*b* follows the curve 1*b*. In the intermediate position between the stationary blade width of Br and Bt, the stationary blade is so formed that each of the lean angles follows the curve 1*c* and 1*d* in FIG. 3. As a result, the shape of the stationary blade has a three dimensional shape, and the stationary blade having a smooth change of the lean angle in the whole region of the blade length of the stationary blade 1 from the inner wall 3*a* to the outer wall 3 is illustrated in FIG. 2. The shape of the stationary blade illustrated with the chain line in FIG. 2 is the shape of a conventional stationary blade for reference. In comparison of the conventional stationary blade with the present invention, the lean angle of the conventional blade at the stationary blade inlet at the outer wall 3 is the point H on the curve 1*b* of the lean angle at the stationary blade outlet in FIG. 3, and the lean angle of the conventional blade is smaller than both the G at the stationary blade outlet and E at the stationary blade inlet of the present invention.

Figure 12:
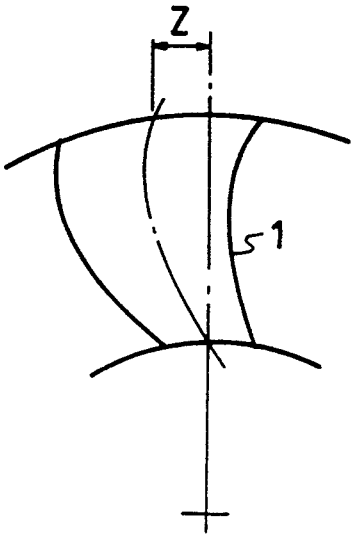
FIGS. 12 and 13 illustrate other embodiments of the present invention.
Figure 13:
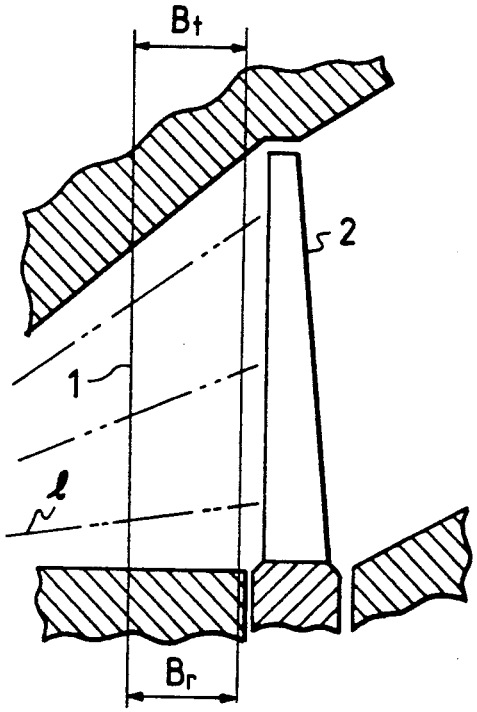

In the above explanation, the curved blade having the central region, which is extruded in the tangential direction, in the blade length direction is explained, but the same effect can be obtained naturally by applying to the curved blade of which the tip side of the blade is shifted tangentially (Z) as illustrated in FIG. 12 and to the blade having same width of the tip Bt and the hub Br as illustrated in FIG. 13.

Figure 4:
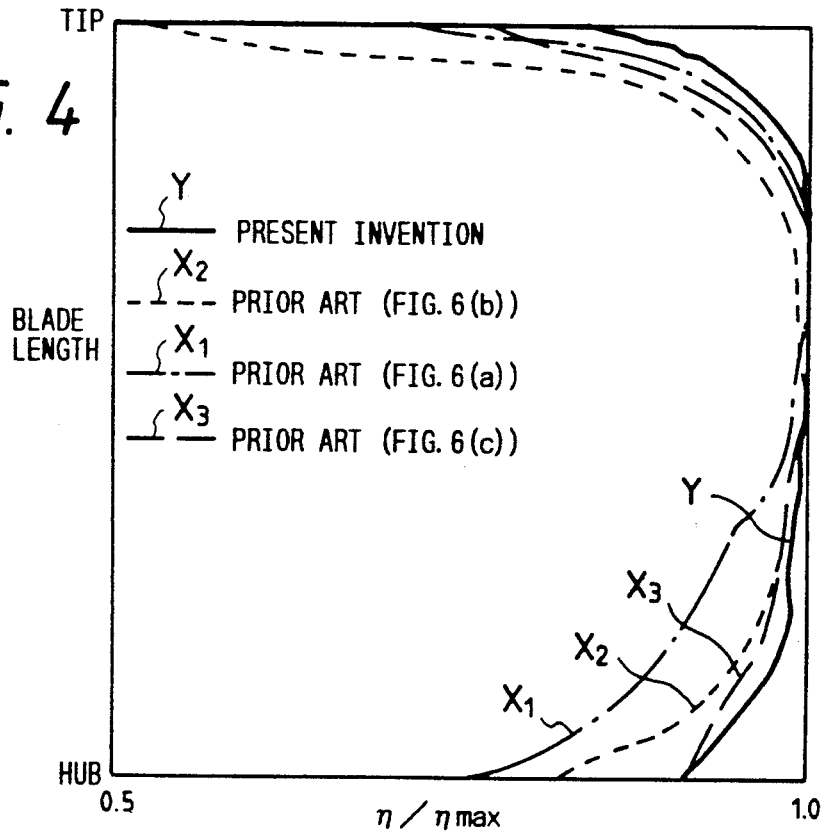
FIG. 4 is a graph illustrating the efficiency distribution in the blade length direction.
Figure 5A:
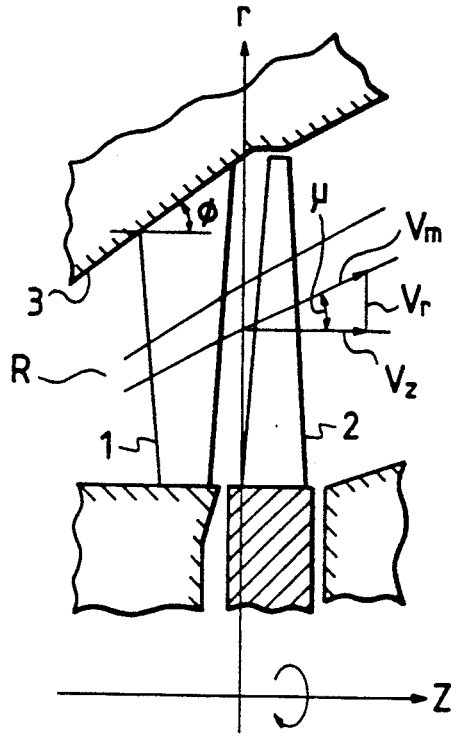
FIG. 5(*a*) is a schematic vertical cross section illustrating the region around the stationary blade.
Figure 5B:
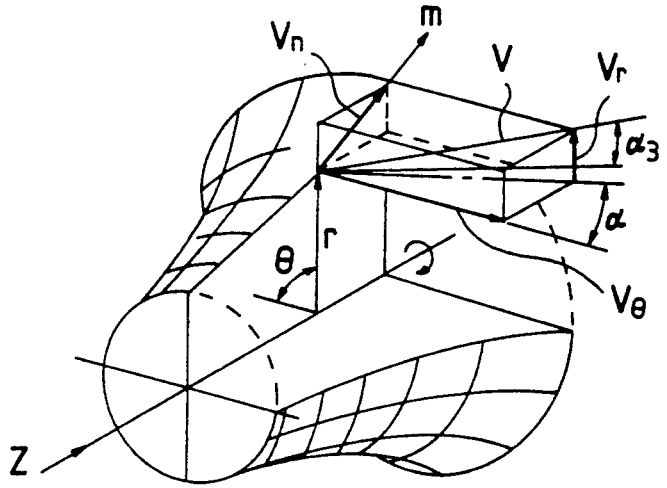

Next, as illustrated in FIG. 4, the stationary blade of the present invention is compared with the conventional stationary blade with respect to the efficiency by experimental results.

FIG. 4 illustrates the relation between the efficiency and each position in blade length direction of the stationary blade. The stage used in the experiment was the one used for a large capacity, and flare angle of the flow channel was 40; the length of the stationary blade was 660 mm; the average width of the stationary blade was 120 mm; the length of the moving blade was 600 mm; and the average width of the moving blade was 90 mm.

In FIG. 4, the curves $X_1$–$X_3$ are on the conventional stationary blades, and the curve Y is on the stationary blade of the present invention.

Figure 6A:
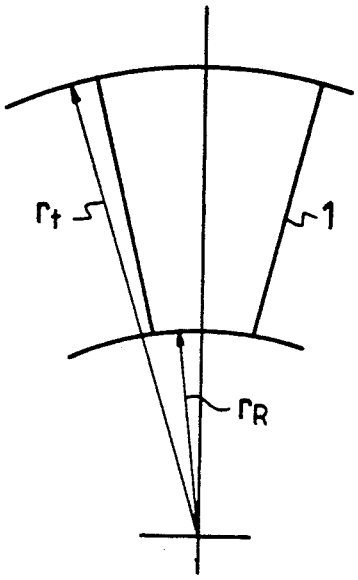
FIG. 6(*a*), (*b*) and (*c*) are schematic front views of the conventional stationary blades.
Figure 6B:
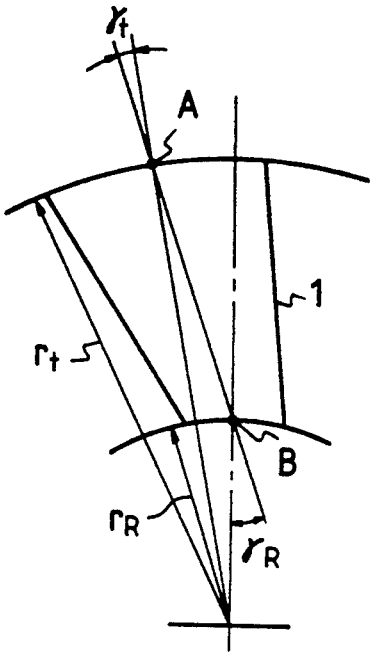
Figure 6C:
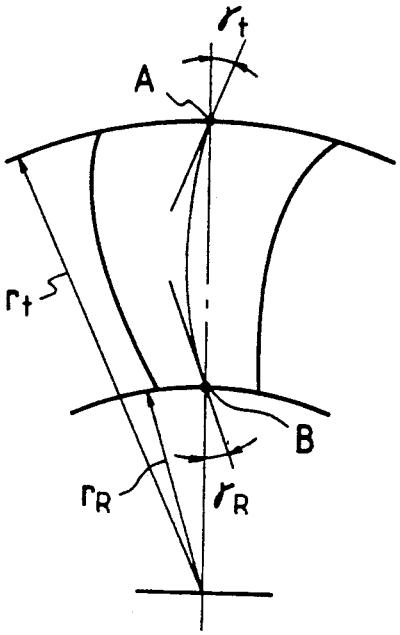
Figure 7:
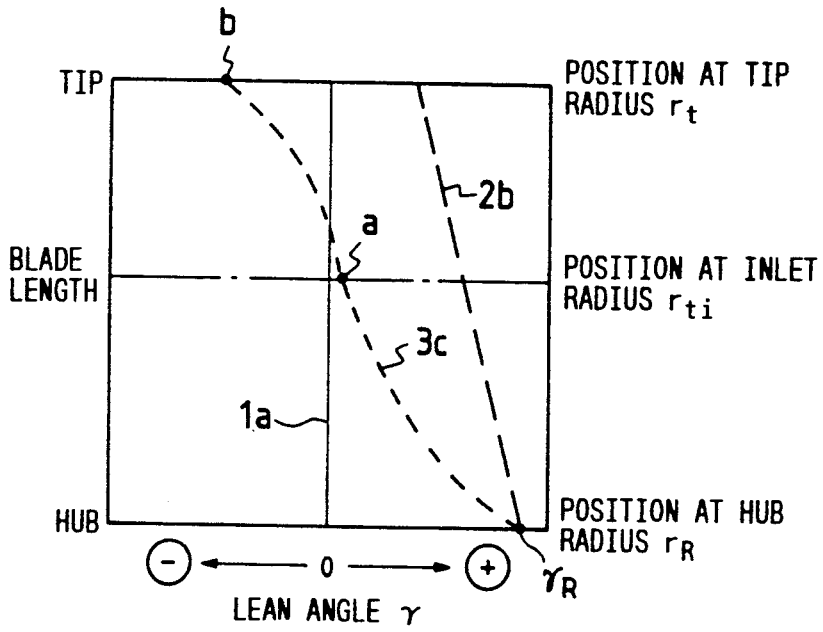
FIG. 7 is a graph illustrating the relation between the blade length of the conventional stationary blade and the lean angle.
Figure 8:
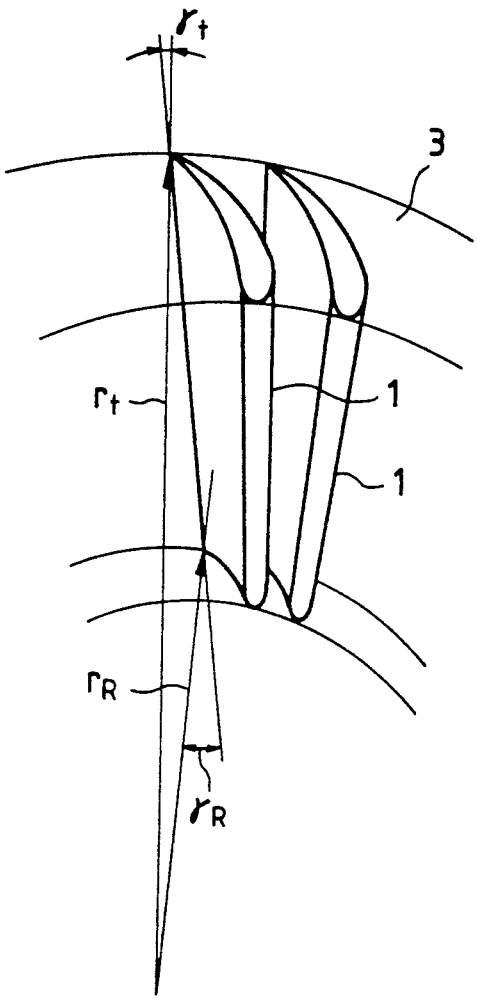
FIGS. 8 and 9 are schematic perspective views illustrating the conventional stationary blades.
Figure 9:
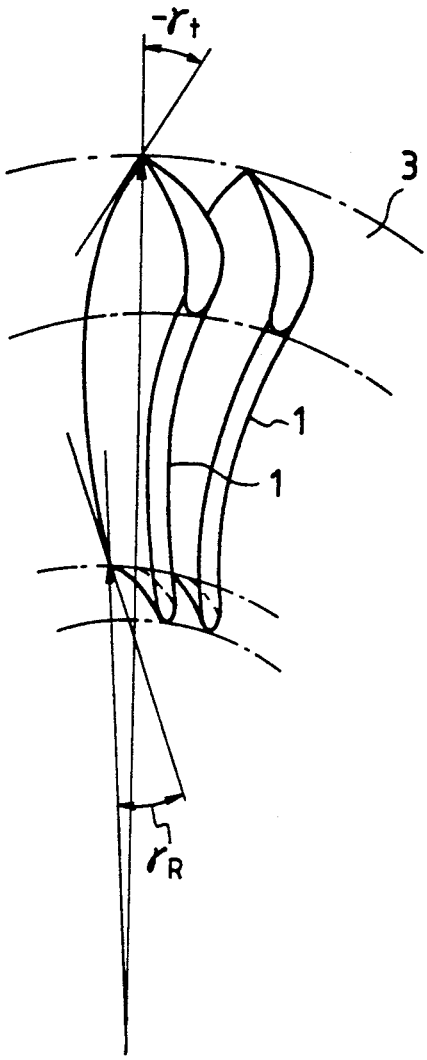
Figure 10A:
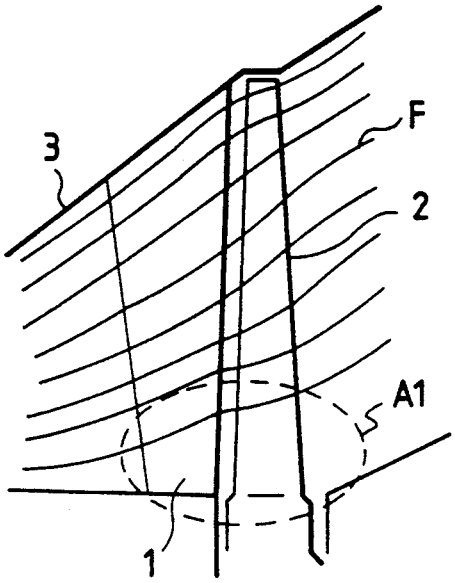
FIGS. 10(*a*), 10(*b*) and 10(*c*) are schematic vertical cross sections illustrating flow lines in the turbine stage of the conventional stationary blade respectively.
Figure 10B:
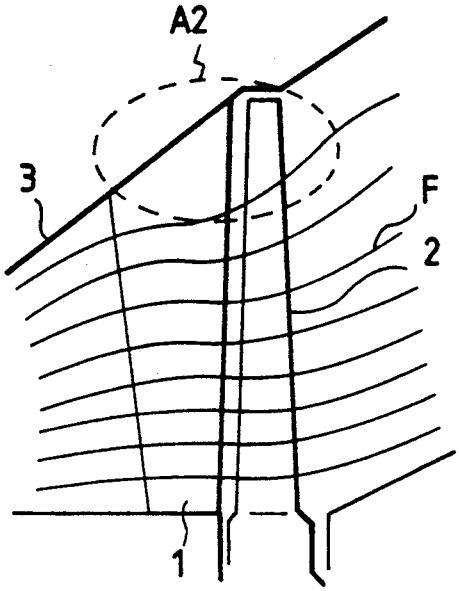
Figure 10C:
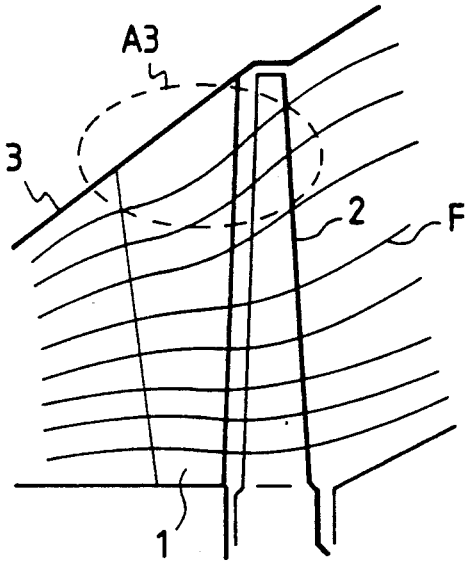
Figure 11:
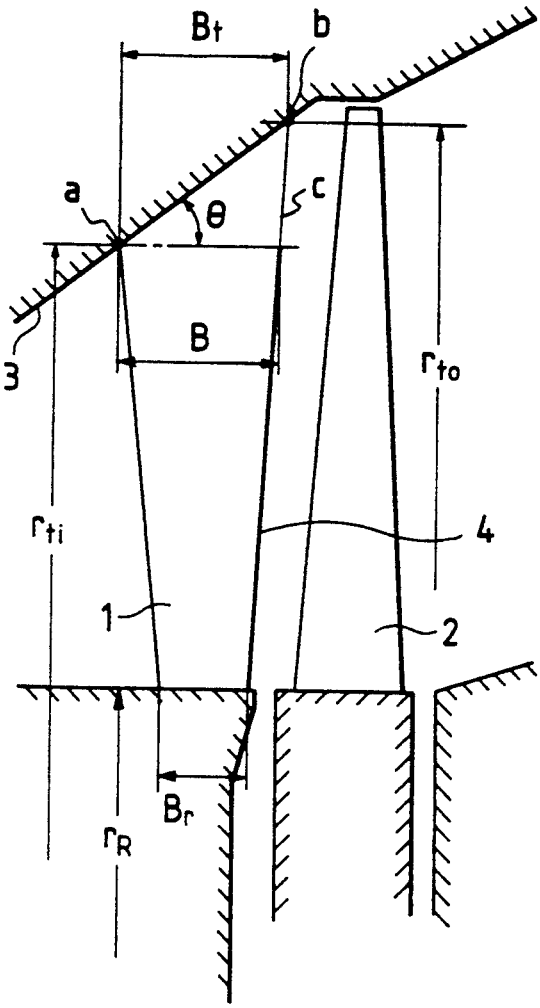
FIG. 11 is a schematic vertical cross section for explanation of the shape of the stationary blade.

The experimental result illustrated in FIG. 4 reveals clearly that the curve $X_3$ is, preferable and the most preferable efficient among the conventional blades. That is, the curved stationary blade illustrated in FIG. 6(*c*) has the move preferable efficiency. In comparison of the stationary blade of the curve $X_3$ with the stationary blade of the present invention represented by the curve Y, the difference between the conventional blade (curve $X_3$) and the blade of the present invention is small at the central region in the blade length direction but is distinguished at the ends of the blade, especially at the tip of the blade, and the blade of the present invention clearly shows high efficiency. From the results described above, it is illustrated that the improvement by 2–3% in the average value of the stage efficiency is clearly achieved.

As described above, in the present invention, the curved lean angles at each position in radial direction of the stationary blade are so formed as to be same on the line which is drawn from the origin of the flare angle of the diverging flow channel in radial direction and intersects the outlet and inlet of the stationary blade, therefore, the stationary blade which is installed even in the diverging flow channel, the effecting force relating to the transference of the fluid in radial direction at each position in radial direction of the stationary blade becomes almost same respectively and, accordingly, the flow of the fluid in the diverging flow channel becomes uniform distribution and the stationary blade having less losses can be obtained.

What is claimed is:

1. An apparatus of a stationary blade for an axial flow turbine comprising:

a flow channel wall forming a diverging flow channel for flowing of an elastic fluid, and said stationary blade being fixed in the flow channel wall and curved in a perpendicular direction to a flow direction of the elastic fluid, wherein tangential lean angles of a leading edge of the stationary blade, when measured on the line drawn from an origin of the diverging flow channel to the stationary blade, are substantially equal.

2. An apparatus of a stationary blade for an axial flow turbine comprising:

a turbine casing having a diverging flow channel for flow of an elastic fluid, and the stationary blade being fixed at the diverging flow channel and curved in a plane perpendicular to an axial direction of the axial flow turbine, and wherein a tangential lean angle of said stationary blade at a portion of a leading edge of said stationary blade is substantially equal to a tangential lean angle of said stationary blade at a corresponding portion of a trailing edge of the stationary blade to said portion of the leading edge with respect to a flow direction of the elastic fluid.

3. An apparatus of the stationary blade for the axial flow turbine as claimed in claim 2, wherein the stationary blade is formed so that the blade width is gradually, progressively enlarged wider in the radial direction.

4. An apparatus of a stationary blade for an axial flow turbine comprising:

a flow channel wall forming a diverging flow channel for flow of an elastic fluid, and the stationary blade being fixed at the flow channel wall and curved in a plane perpendicular to an axial direction of the axial flow turbine, and wherein a tangential lean angle of the stationary blade is formed so that an angle in a radial direction of the elastic fluid entering the stationary blade is substantially equal to an angle in the radial direction of the elastic fluid discharged from the stationary blade.

5. A stationary blade for an axial flow turbine, for installation in an interior of a flow channel which is progressively widened in a downstream direction of a fluid flow, said stationary blade being curved in a tangential direction wherein tangential lean angles at each position in the radial direction at the inlet and at an outlet of the stationary blade are formed to be substantially equal on an imaginary line drawn in a radial direction from an origin of the flare angle of the flow channel so as to intersect the stationary blade.

6. A stationary blade for an axial flow turbine, for installation in an interior of a flow channel which is progressively widened in a downstream direction of a fluid flow, said stationary blade being curved in a tangential direction, wherein tangential lean angles at a leading edge and at a trailing edge of the stationary blade are formed to be substantially equal.

7. An apparatus of stationary blades for an axial flow turbine comprising:

a casing forming a diverging flow channel for flow of elastic fluid, and the stationary blades each being fixed in the diverging flow channel and curved in a tangential direction so that tangential lean angles at each position in the radial direction of each of the stationary blades on a line in the radial direction from an origin of a flare angle of the diverging flow channel toward the stationary blade are substantially equal.

8. An apparatus of a plurality of stationary blades for axial flow turbine comprising:

a casing forming an annular diverging flow channel for flow of elastic fluid, and said stationary blades being arranged in the diverging flow channel at predetermined circumferential intervals and curved in a tangential direction, wherein tangential lean angles at a leading edge and at a trailing edge of the stationary blade are selected so that a flow angle of an elastic fluid flow at the leading edge in a radial direction between an inlet and an outlet of each of the stationary blades are substantially equal to an angle of the elastic fluid flow of the trailing edge in the radial direction when the elastic fluid passes between the stationary blades.

9. An axial flow turbine comprising:

a casing having a diverging flow channel for flow of elastic fluid, stationary blades provided in the diverging flow channel in the casing, said stationary blades each being formed in such a shape curving in a tangential direction that tangential lean angles at a leading edge and a trailing edge thereof, and moving blades arranged downstream of the stationary blades.

10. An axial flow turbine comprising:

a plurality of stationary blades provided in an annular diverging flow channel for flow of elastic fluid, wherein each of said stationary blades is curved in a direction perpendicular to an axial direction of the axial flow turbine so that an entering angle in a radial direction of the elastic fluid into an interval between the stationary blades is equal to a discharging angle in a radial direction of the elastic fluid from the interval.

* * * * *